US007918103B1

(12) United States Patent
Purvis

(10) Patent No.: US 7,918,103 B1
(45) Date of Patent: Apr. 5, 2011

(54) AIR FLOW COMFORT SYSTEM

(76) Inventor: Hugh Purvis, Baltimore, MD (US)

( * ) Notice: Subject to any disclaimer, the term of this patent is extended or adjusted under 35 U.S.C. 154(b) by 1077 days.

(21) Appl. No.: 11/635,464

(22) Filed: Dec. 7, 2006

(51) Int. Cl.
*F25D 23/12* (2006.01)

(52) U.S. Cl. ..... 62/259.3

(58) Field of Classification Search ..... 62/259.3, 62/401, 87
See application file for complete search history.

(56) References Cited

U.S. PATENT DOCUMENTS 1,489,308 A * 4/1924 Cox ..... 297/452.43
4,132,262 A * 1/1979 Wibell ..... 165/206
4,777,802 A 10/1988 Feher
4,867,230 A 9/1989 Voss
5,336,250 A 8/1994 Augustine
D359,810 S 6/1995 Namenye
5,473,783 A * 12/1995 Allen ..... 5/652.2
5,655,237 A 8/1997 Suzuki et al.
5,675,848 A * 10/1997 Kappel ..... 5/482
6,171,333 B1 * 1/2001 Nelson et al. ..... 607/104
6,558,413 B2 5/2003 Augustine et al.
2003/0145380 A1 8/2003 Schmid

* cited by examiner

*Primary Examiner* — Melvin Jones
(74) *Attorney, Agent, or Firm* — Lawrence J. Gibney, Jr.

(57) ABSTRACT

This is a device to provide airflow comfort to an individual while sleeping. It will be comprised in part by air flow that is provided by a fan. The air flow may be cooled. The air that is provided escapes through a series of holes on the top of the device.

5 Claims, 3 Drawing Sheets

AIR FLOW COMFORT SYSTEM

BACKGROUND OF THE INVENTION

A. Field of the Invention

This relates to comfort in a bed and specifically providing a cool stream of air over a person during sleep. The stream of air may also be heated if desired.

B. Prior Art

There are many other prior art references related to sleeping and airflow during sleep. A representative example of the type of prior art can be found is Voss, utility U.S. Pat. No. 4,867,230. Voss is a convection blanket warmer, not a cooling one as this device, which has an air connection, a plurality of specifically designed pinholes in the top surface as well as several layers of insulated materials and metallic foil. Another example in the prior art is Feger, U.S. Pat. No. 4,777,802. It is a blanket assembly to provide heated or cooled air within the blanket assembly. Feger does not have the plurality of holes on the top but merely provides a layer of air during sleep as well as an ability to adjust the heat within the device. Another example is Augustine, U.S. Pat. No. 5,336,250. This is a thermal blanket with a transparent upper body drape. This also has a means to provide air into the blanket as well as a series of pinholes.

None of the other prior art structures are identical or made obvious by the prior art and, therefore, this device is novel and not obvious.

BRIEF SUMMARY OF THE INVENTION

This is an airflow comfort system. It will be used with a comforter to provide a blanket of air over a person while the individual sleeps. A connection to allow air to pass through a series of tubes in the device will be provided.

When the device is operational, an air compressor will provide an airflow through the tubing. Additionally, the individual may be able to moderate or regulate the fan speed as well as the cooling of the incoming air. Cooling of the air is provided with a series of coils. The device will be powered by standard electrical current and a plug.

It is an object of this device to provide an airflow system, which will provide comfort to an individual during sleep, as well as cut down on dust mites and other bed infestations. An additional benefit is the reduction of energy by not having to use the air conditioner as much.

It is a further object to provide a steady stream of air through a series of tubes to provide flow of air throughout the device while the individual is sleeping.

DETAILED DESCRIPTION OF THE EMBODIMENTS

Figure 1:
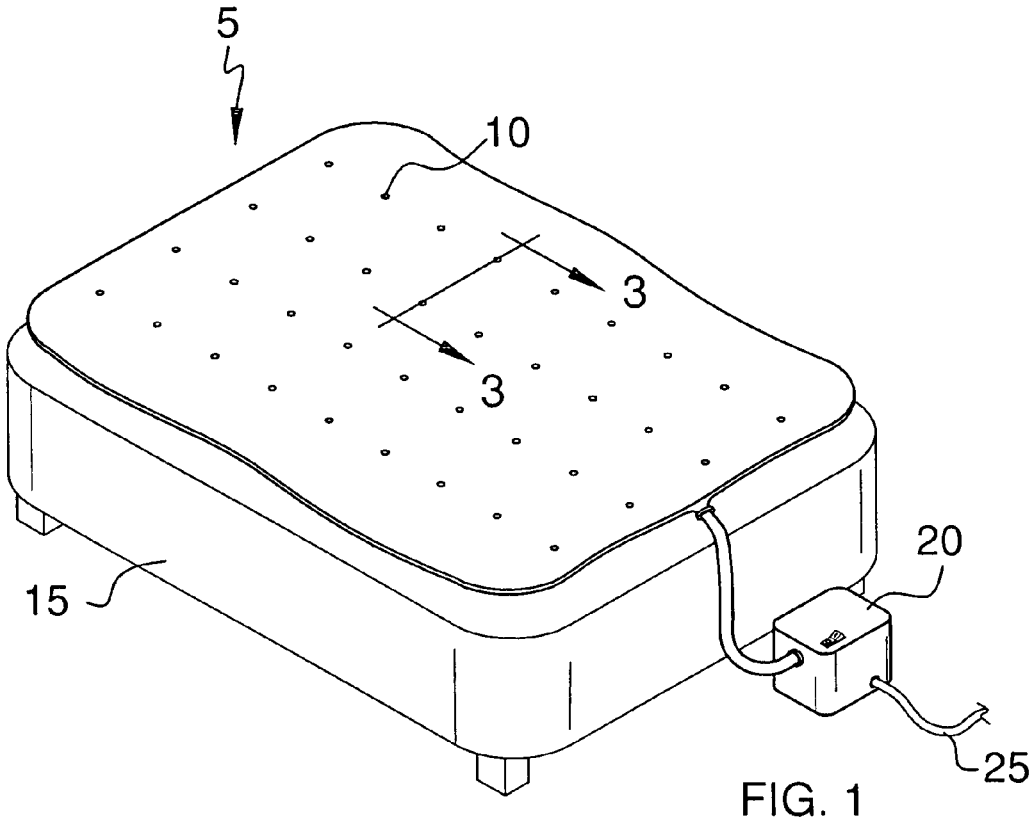
FIG. 1 is an isometric view of the device.
Figure 2:
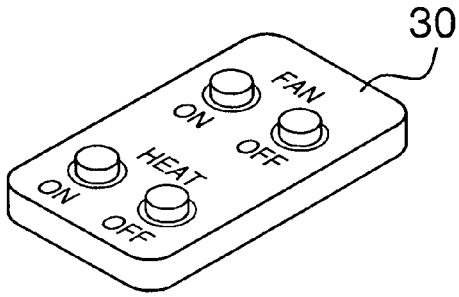
FIG. 2 is an isometric view of the remote control.
Figure 3:
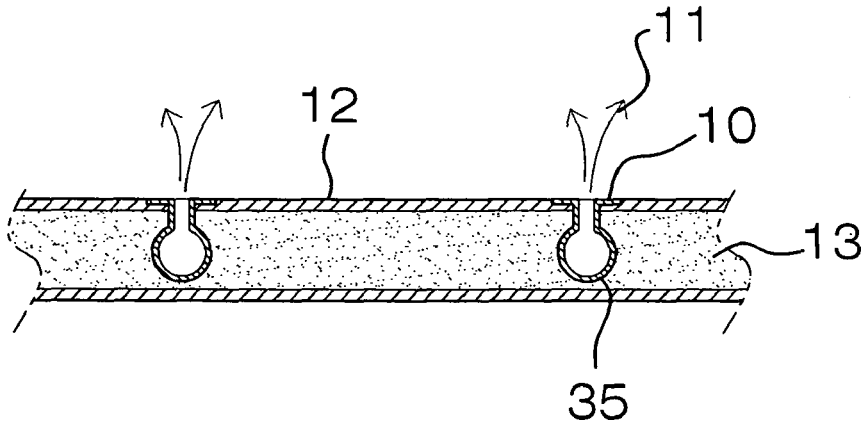
FIG. 3 is a view according to line 3-3 on FIG. 1.
Figure 4:
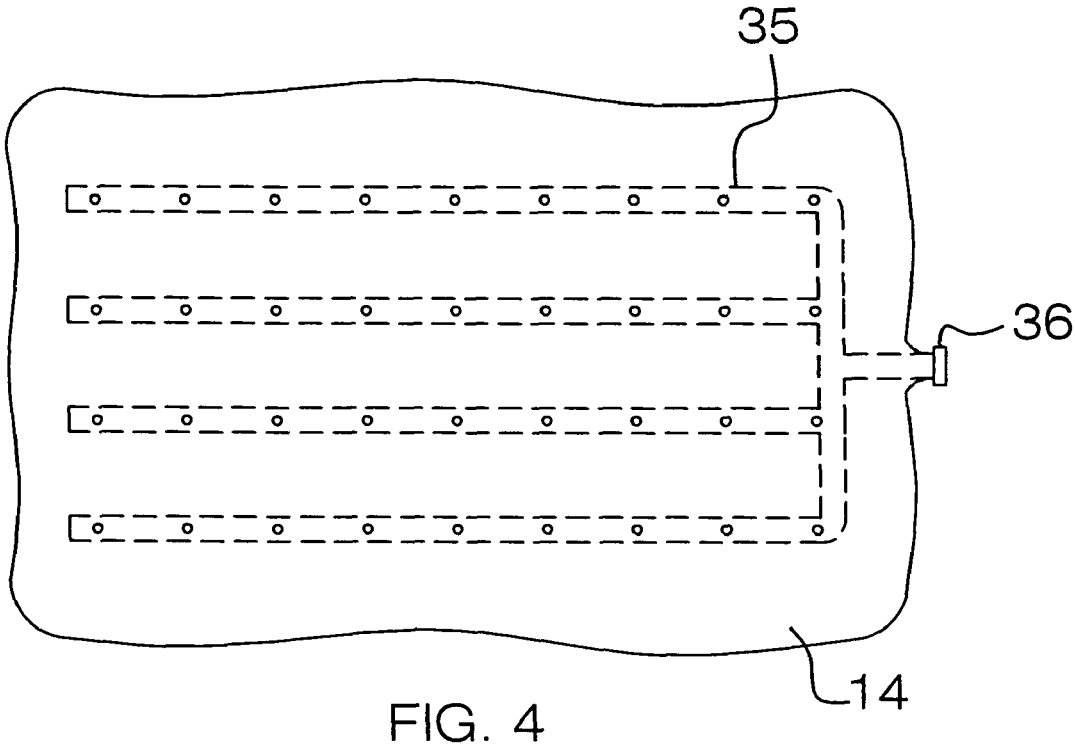
FIG. 4 is a top view of the device with the air tubing shown by dashed lines.
Figure 5:
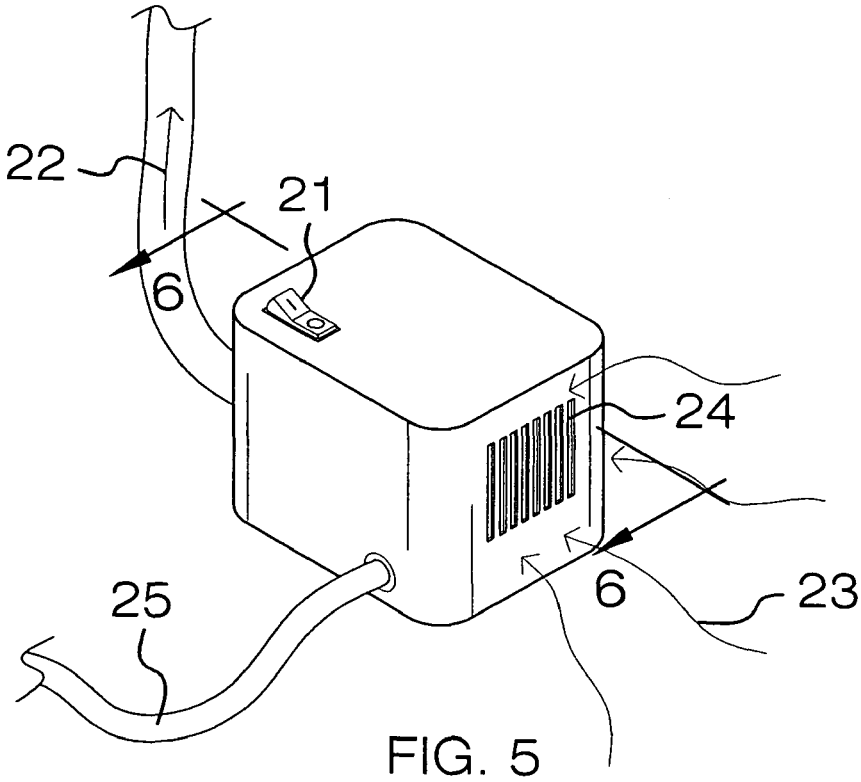
FIG. 5 is a fragmented isometric view of the air compressor.
Figure 6:
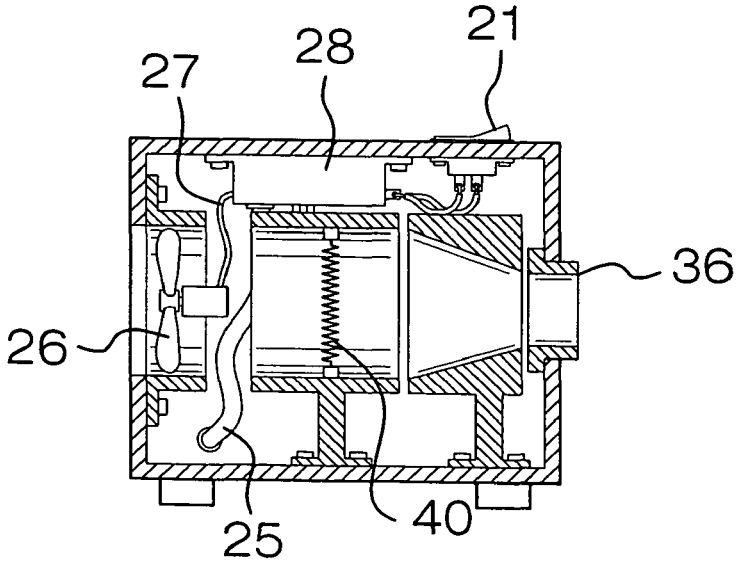
FIG. 6 is a view according to line 6-6 on FIG. 5.

This device 5 is an Airflow comfort system. It will be installed in a comforter, which is placed on a bed 15 above the mattress. It will have a top surface as well as a bottom surface and a side surface and will enclosed by the comforter. At one end of the device, there will be a means to connect an air supply 36.

Within the device will be a series of tubes 35, which will allow air from a compressor 20 to be pumped through the air connection 36 to the tubing 35. The air compressor 20 will most likely be powered by a standard electrical outlet, using a plug 25. The air will flow through the air connection through an inlet, using a fan 26. A series of coils 40 within the compressor can be activated by a remote control 30. The remote control will regulate the compressor speed as well as the amount of cool air through the coils.

The air is forced through the tubing by the compressor 26, past the coils 40 and into the air connection 36. The air connection then directs the air through the air tubing manifold 35. A plurality of pinholes is strategically located on the top surface of the device to ensure that a steady stream of air flows through the manifold and out the holes to comfort the individual while sleeping. The compressor is operated by a switch 21 and a controller 28. Appropriate wiring 27 is also provided between the plug 25, switch 21, controller 28, fan 26 and compressor. Additionally, wiring is provided to power the coils 41, if desired. A remote control device 30 may also be used to control the speed of the fan.

The air holes 10, which are placed on the top surface of the tubing, allow a steady stream of slightly pressurized air 11 to pass through the holes of the top surface 12 while the person sleeps.

The tubing 35, which is installed should be somewhat semi-rigid in order to allow air to flow through the device without crimping with all types of bodies.

Additionally, there will be material 13, which is used in existing comforters that will surround each piece of tubing 35 and provide additional support. This device will be incorporated as part of a mattress comforter 14.

The inventor claims:

1. An airflow comfort system, which is comprised of:

a. a comforter;

wherein the comforter has a defined shape;

wherein the comforter rests on tops of a bed;

b. air supply;

wherein an air supply is provided;

c. tubing;

wherein tubing is embedded in the comforter;

wherein a tubing connection is provided on one end of the comforter;

wherein the tubing is connected to the air supply;

wherein the tubing allows air to flow from the air supply through said tubing;

wherein a plurality of pinholes is provided in the tubing;

said pinholes allow a stream of air to escape from a top surface of the tubing;

d. coils;

wherein a series of coils is provided to cool the air supply;

e. power source;

wherein a power source is provided;

f. means to regulate the air flow;

wherein a means to regulate the air flow is provided.

2. The device as described in claim 1 wherein the power source is alternating current.

3. The device as described in claim 1 wherein a compressor is controlled by an on-off switch.

4. The device as described in claim 1 wherein a remote control is provided.

5. The device as described in claim 4 wherein the remote control regulates the speed of a fan.

* * * * *